United States Patent [19]

Scott

[11] 4,118,004

[45] Oct. 3, 1978

[54] CONCRETE BEAM FORM

[76] Inventor: Samuel Clyde Scott, 2419 Walnut St., Denver, Colo. 80205

[21] Appl. No.: 797,196

[22] Filed: May 16, 1977

[51] Int. Cl.[2] ..... E04G 13/04

[52] U.S. Cl. ..... 249/50; 249/112; 249/159; 249/172

[58] Field of Search ..... 249/28–30, 249/50, 155, 159, 112, 172

[56] References Cited

U.S. PATENT DOCUMENTS

| | | | |
|---|---|---|---|
| 1,502,323 | 7/1924 | Acher | 249/50 |
| 2,874,442 | 2/1959 | Henderson | 249/155 |
| 3,063,122 | 11/1962 | Katz | 249/50 |

FOREIGN PATENT DOCUMENTS

| | | | |
|---|---|---|---|
| 650,011 | 12/1928 | France | 249/159 |

*Primary Examiner*—Francis S. Husar
*Assistant Examiner*—John McQuade
*Attorney, Agent, or Firm*—Richard D. Law

[57] ABSTRACT

A lightweight, take-down beam form, including a series of U-frames held together by spaced apart adjustable longitudinal braces secured along the frame uprights and bottom longitudinal braces, support strippable plywood or plastic or suitable material beam forming sheets. The U-frames are bolted together for easy and quick assembly and easy disassembly when in place on a cured concrete beam, permitting easy release of the forming sheets from completed and cured concrete beams. For normal use, the form strips from a set beam as a modular unit. For some purposes, such as for spandrels, one or both sides could be released for the removal of the form.

5 Claims, 8 Drawing Figures

CONCRETE BEAM FORM

BACKGROUND OF THE INVENTION

In some types of concrete construction, the design includes integral horizontal beams and decks. In this type of construction, the decks have generally smooth, horizontal tops, while the beams extend below the decks. Numerous problems occur in the assembly of the forms and during pouring of concrete in the deck forms, since such forms will contain a substantial quantity of concrete which is heavy, bulky and plastic when poured. Thus, the forms, where the concrete beams are formed in place, have been heavy and bulky to make the forms rigid enough to support the concrete. A major problem is also encountered in the removal of the forms from the cured concrete, particularly since concrete has a propensity of sticking to the forms even after curing and hardening. Since the forms for forming the concrete decks and beams must be below the cured concrete, they must be removed by moving directly downwardly.

PRIOR ART

In an early patent to Holberk, U.S. Pat. No. 982,055 issued Jan. 17, 1911, a beam and deck form are shown in which wooden members provide support for the form walls, and the construction is such that the total deck and beam forms must be dropped from the finished structure. This is normally accomplished by removing the bottom of the uprights supporting the forms in position. The invention of U.S. Pat. No. 1,090,583, has a beam form using take-down uprights which bolt to the metal sheets supporting the beam concrete. The beam form is not provided with longitudinal supports and is subject to severe racking, even though formed of heavy steel sheets. Further, the weight and bulk of the unit requires an undue amount of vertical support for securing the unit in place along with deck forms. A similar type of construction is shown in the Katz U.S. Pat. No. 3,063,122, issued Nov. 13, 1962, in which the beam form includes steel plates mounted on laterally braced uprights which may be taken apart for removal from the completed concrete structure. Longitudinal support is achieved by bent-over top edges of the metal sheets forming the beam form. This, of course, produces a heavy bulky form which again is subject to racking since the longitudinal support is only along the top. The construction of the beam forms of the three patents is such that only a single design of beam may be produced by each form.

OBJECTS OF THE INVENTION

According to the present invention there is provided a lightweight modular beam form which provides lightweight forming panels adequately braced along their length for supporting heavy concrete loads producing beams.

Another object of the invention is to provide a lightweight, knock-down beam form for shipping, and when assembled is not subject to normal racking and twisting moments.

Another object of the invention is to provide a beam form which is adjustable without changing the yokes, for producing different shapes of beams, providing adequate support for forming sheets which form the beam cavity, and for supporting the concrete for the beams.

Another object of the invention is to provide a lightweight rigid beam form arranged for attachment to deck forms producing integral beam-deck structures.

Yet another object of the invention is to provide adjustable forms which are arranged for adequately supporting plywood sheets in various configurations for producing various designs of concrete beams.

Still another object of the invention is to provide a beam form for producing concrete beams having architectural surfaces, which beam forms are easily stripped from a finished cured concrete beam.

GENERAL DESCRIPTION OF THE DRAWINGS

These and other objects on the advantages of the invention may be readily ascertained by referring to the description and the appended illustrations in which.

Figure 1:
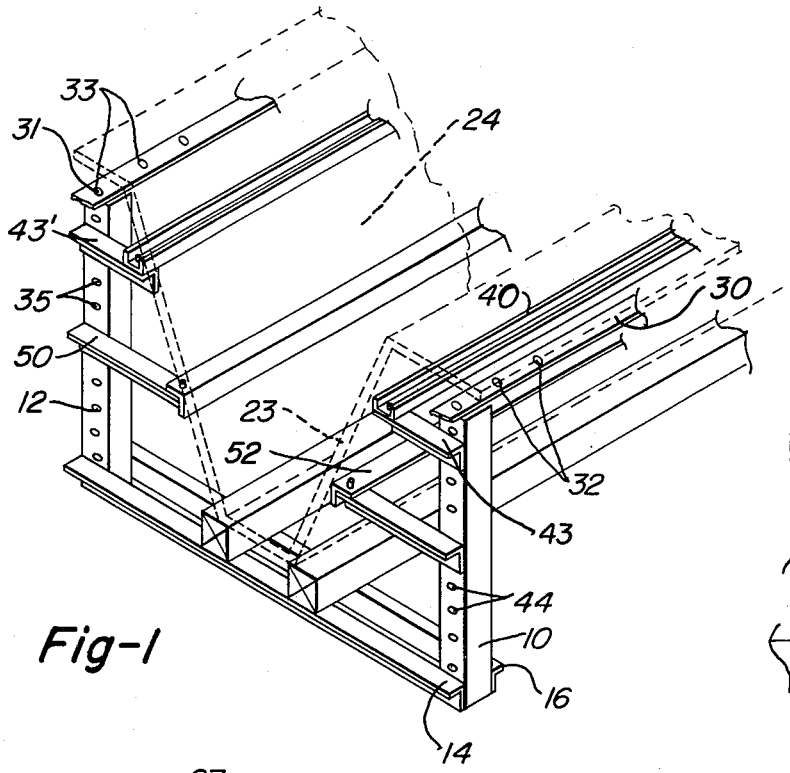
FIG. 1 is a perspective view of a portion of a beam form, showing the major components of the form support means.
Figure 5:
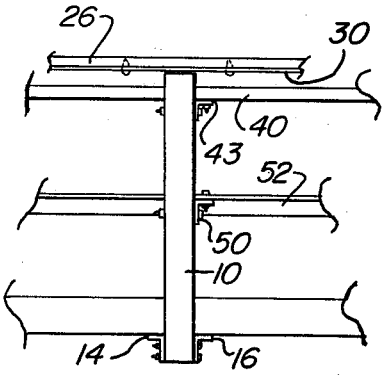
FIG. 5 is a detailed side elevational view of a vertical support, according to the invention, providing a brace for the longitudinal brace members.
Figure 2:
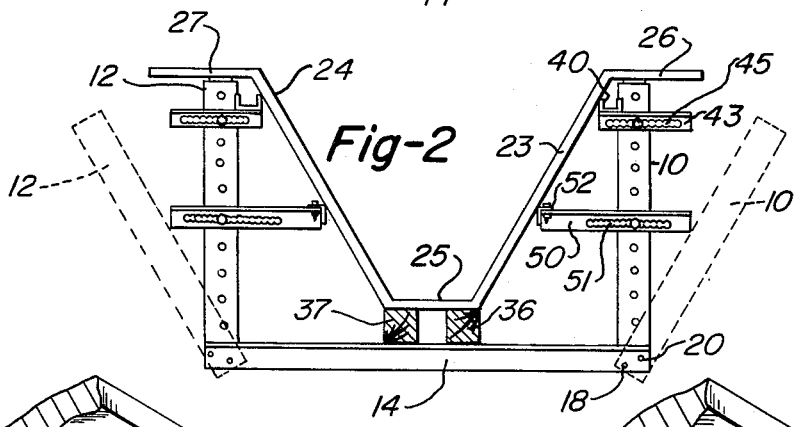
FIG. 2 is an end elevational view of the beam form structure, showing the placement of forming panels with supporting structure.
Figure 3:
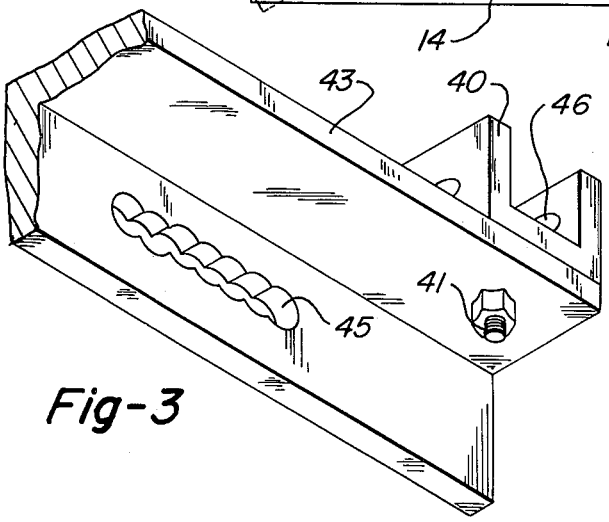
FIG. 3 is a perspective view of an ajdustable bracket for a longitudinal brace means for a form according to the invention.
Figure 4:
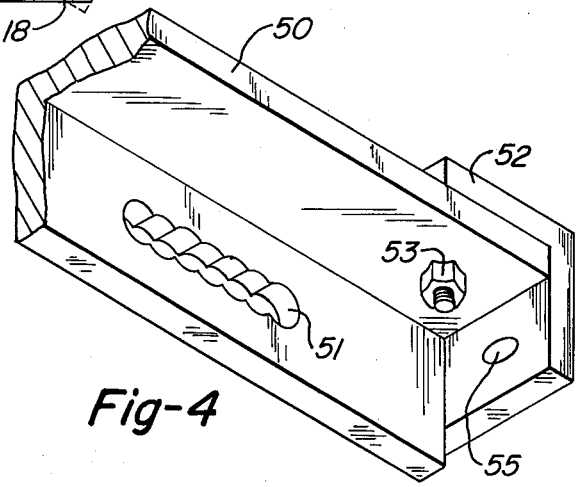
FIG. 4 is a perspective view of still another support for a longitudinal brace for beam form components.

A preferred form of the device, shown in FIGS. 1–5, is a beam form which generally includes a series of spaced apart U-shaped brackets and attached horizontal supports for longitudinal stringer supports for the forming panels (usually plywood but may be of other materials), forming the cavity for the beam. The U-shaped supports may be spaced from 2, 3, 4, or 5 feet along the length of the beam, as desired. At least two horizontal, longitudinal braces are arranged on both sides of the forming sheets to support the generally upright forming sheets under the hydraulic pressure and the weight of the concrete placed in the beam form. The bottom member of the forming sheets sits on two or more horizontal, longitudinal stringers resting on the web or cross member of the U-shaped members.

Each U-shaped member includes a pair of spaced apart, rectangular steel uprights 10 and 12. The uprights are secured to a pair of angle members 14 and 16, secured to opposite sides of the rectangular uprights 10 and 12. For normal circumstances, the uprights are secured to the angles by means such as tack welding or in some cases, by means of bolts. The holes for bolts are normally two in number, and are arranged with the inner bolt hole 18 at a low level and the outer bolt hole 20 at an upper level. This permits the uprights of the U-shaped member, by removal of the bolt from hole 20 (the upper bolt), to swing outwardly and downwardly away from the upright position, without interference with a deck panel mounted on the unit, explained below. Forming panels or sheets (plywood, plastic—such as fiberglass, etc.) are mounted in the upright framework producing the beam cavity and providing the exterior surfaces of the beam to be formed. Such panels form the sides and bottom of the beam. As shown, the beam panels include panel 23 on the one side and panel 24 on the opposite side converging on the bottom panel 25. The panels 23, 24 and 25 may be plywood, pressed wood, plastic, glass fiber panels, etc., preferably with the inner surface having a waterproof coating, for example, a synthetic plastic or resin, etc., which provides a smooth, slick surface contacting the concrete and providing a release of the panel from the concrete. The tops of the square upright tubes may be secured together by means of a wooden strip 30 on the one side, and a wood strip 31 on the opposite side. These strips may be 2 × 6 or other sizes as desired. These strips may be secured by bolts and a series of holes 33 may be bored in the strip 30 and holes 33 in the strip 31 on the opposite side. The holes are arranged for screw attachment of deck connecting forms, for example, form portion 26 on the right side of the beam of FIG. 2 and the deck form 27 on the left side.

The configuration and shaping of the forming panels 23–25 are arranged to form the shape of the beam desired. The bottom panel 25 rests on 4 × 4 wooden beams 36 and 37. The beams may be secured by bolts or lag screws through holes in the cross members 14 and 16 of the U-shaped member. The 4 × 4 beams extend along the length of the beam and support the bottom sheet 25 of the beam panels. The beam sheet may be secured on the 4 × 4's by bolts, nails, or the like. The side beam panels 23 and 24 are secured in place by means of longitudinal braces or stringers, these including an upper, channel-shaped, longitudinal stringer 40. The channel 40 is bolted by means of bolt and nut sets 41 to an horizontal brace 43 which is bolted to the uprights 10 by bolts passing through one of the holes 44 in the uprights 10 and 12. The horizontal member 43 is secured to the upright by means of a bolt passing through one of the notches of the variable opening 45, permitting the horizontal angle support to be placed in proper position with the stringer 40 braced against the panel 23. A series of holes 46 bored through one of the legs of the channel 40 provide means for attachment of the channel to the panel 23 by means of bolts, screws, nails or the like. Another horizontal support 50 with an opening 51 for a variable attachment is arranged for mounting on the upright 10 by means of a bolt and nut set through one setting of the opening 51. A channel 52 is mounted, by means of a bolt nut set 53, to the outer edge of the horizontal brace abutting the panel 32, and a series of holes 55 in the channel provide means for attachment of the angle to the panel 23 by means of screws, nails, bolts, or the like.

The horizontal brackets or braces provide means for adjustably supporting the horizontal stringers in position to bear against the beam panels. This adjustability provides means for producing different shapes or designs of beams with the same equipment. Thus beams may be formed with draft, that is sloped sides, or no draft, that is vertical sides. While the form is usually welded, the nut and bolt construction provides means for the release of the form from the cured concrete beam where necessary. By merely removing the upper outside bolt of the connection between the uprights and the horizontal angles of the U-shaped frame, the form side may be pivoted downwardly. This permits the longitudinal stringers and the attached beam forming side sheets to be removed from the beam.

The arrangement provides a modular form which may be easily adapted to different shapes of beams. The modular construction lends itself to any length of beam, with the U-shaped uprights providing means for supporting the beam form, and means for supporting its position in the construction. Thus, the modular beam form is produced of essentially lightweight materials producing lightweight but very strong beam forms which are easily secured together and with deck, column or other forms. It produces a strong beam form which does not rack or twist under the forces of the construction. Since the beam panels are adequately braced by means of the longitudinal stringers, no ties are necessary to hold the generally upright beam form panels. Ties are normally used for preventing forms from sagging and bulging under the weight of the concrete.

Figure 6:
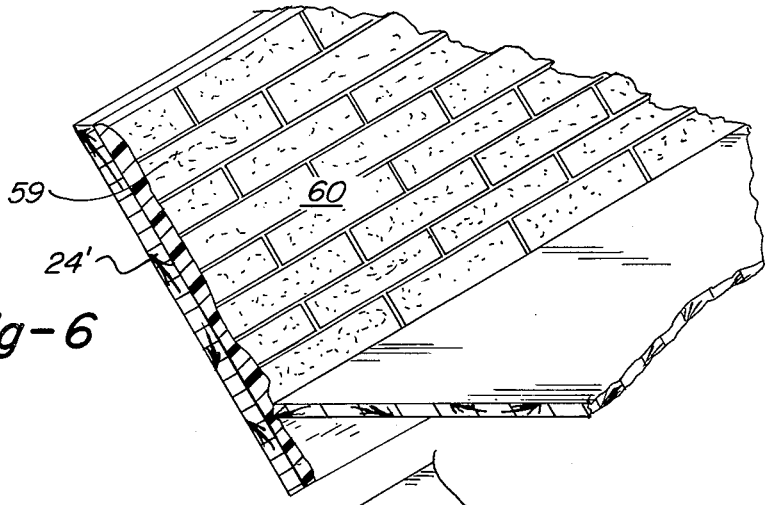
FIG. 6 is a perspective schematic view of a liner for a beam form for producing various representations on the surface of the beam in its finished form.
Figure 8:
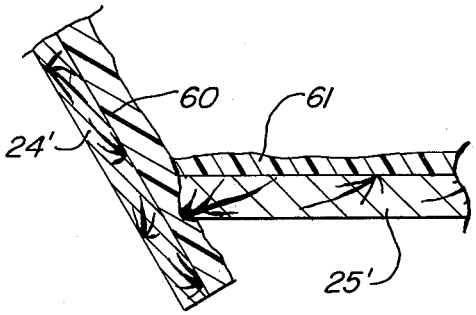
FIG. 8 is an enlarged detailed view of a beam form utilizing a form liner with the lining providing a seal means for the forming panels.

The form of the invention is easily adapted to produce architectural, surfaced concrete beams. For example, as shown in FIG. 6, beam panel 24' is coated with a layer of resilient, flexible coating 59 having impressed on its inner surface 60 the negative of the impression desired in the surface of the concrete beam. A brick motif is shown. However, any other shapes or designs may also be formed as for example, weathered barnwood, rock, stone, or other desired surface configurations. As shown in FIG. 8, the bottom panel 25' of the beam form is arranged to wedge into the elastomeric liner 60 to form a seal between that member and the side panel. Furthermore, a liner 61 may be provided on the bottom panel 25' to provide a similar surface to the bottom of the beam as the side. The liner 61 also seals to the liner 60 of the side panel 24' to prevent any leaking of cement or cement water from the concrete placed in the beam form.

Figure 7:
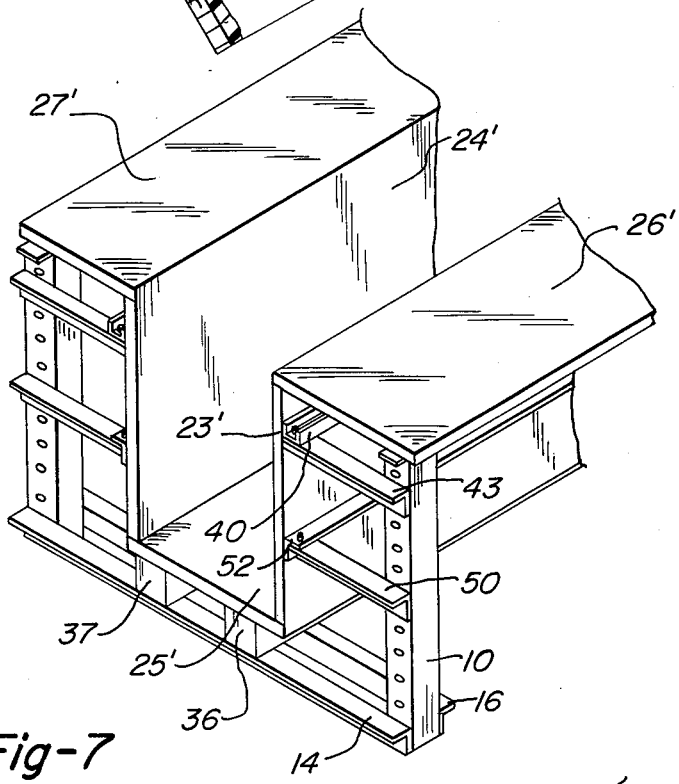
FIG. 7 is a perspective, detailed view of a beam form illustrating the formation of a generally rectangular shaped beam, with plywood members of the beam form being supported in the longitudinal braces and U-shaped frame members, according to the invention.

As shown in FIG. 7, the invention is arranged to provide a vertical sided beam, or a beam with sides of no draft. In this case, panels 23', 24' and 25' are positioned to form a rectangular shaped beam joining the top deck connectors 26' and 27'. The panel 23' is secured in its vertical position by means of a longitudinal brace 40 secured to horizontal support 43 extended to contact and be secured to the top of the panel 23'. In a similar manner, the longitudinal stringer 52 is secured to the panel and it is held into position by its horizontal brace 50 mounted on the uprights 10. The horizontal 4 × 4's 36 and 37 are secured in position on the horizontal angles 14 and 16 to adequately support the bottom panel 25'. Thus, is seen that the adjustability of the form members provides means for producing different designs or shapes of beams. Furthermore, the members of the form are interchangeable with other forms, thus providing a modular unit and an easily usable beam form. Reinforcing steel may be positioned in the beam cavity by conventional methods.

The construction of the U-shaped members and the stringers permits the beam forms to be completely taken apart, bundled and shipped to location in the knocked-down position. This, of course, provides economy in the shipment of the elements, since they are not shipped assembled in actual beam form. Where the forms are to be used for a relatively long term, that is in a large building or in a series of buildings, and where the beam shape remains the same, the parts are normally tack welded together for the long term use. This is so where the use is in one particular location.

The open construction of the beam forms permits insulation of the forming members for cold weather or hot weather use. This is easily accomplished by adhering or glueing strips of insulating material to the exterior side of the beam forming panels. For example, foamed styrene panels are easily adhered to the exterior surfaces of the forming panels to insulate the same for use. Also, insulated panels may be used.

I have now described my invention in considerable detail. However, it is obvious that others skilled in the art can build and devise alternate and equivalent constructions which are nevertheless within the spirit and scope of my invention. Hence, I desire that my protection be limited, not by the constructions illustrated and described, but only by the proper scope of the appended claims.

I claim:

1. A light weight form for concrete beams comprising:

(a) a plurality of yokes each in the shape of a general U-shaped metal member, having upright legs and at least one horizontal member and said yokes spacedly arranged along the length of the form;

(b) an upper, adjustable metal arm extending generally horizontally inwardly on each leg of each yoke, arranged for adjustment inwardly and outwardly;

(c) a lower, adjustable metal arm extending generally horizontally inwardly on each leg of each yoke below the associated upper arm, and each lower arm arranged for adjustment inwardly and outwardly;

(d) a longitudinal stringer mounted on the inner ends of the upper arms providing opposed longitudinal braces;

(e) a longitudinal stringer mounted on the inner ends of the lower arms providing opposed longitudinal braces;

(f) at least two continuous, longitudinal braces resting and mounted on the horizontal members of said yokes; and (g) a continuous beam forming sheet mounted in said yokes in upright position on each side with each sheet fastened to the respective stringers and a continuous generally horizontal beam forming sheet secured to the horizontal longitudinal braces with said side sheets forming a tight joint with said generally horizontal sheet.

2. A light weight form for concrete beams according to claim 1 wherein holes are formed in the upright legs and the horizontal member for joining the same in a U-shape, said holes are arranged in at least pairs in spaced vertical alignment with the inside hole being near the inner edge of the legs permitting the leg to pivot downwardly on a bolt through the hole.

3. A light weight form for concrete beams according to claim 1 wherein said adjustable arms are bolted to the yoke legs with an elongated slit in the arms providing inward and outward adjustment.

4. A light weight form for concrete beams according to claim 1 wherein said adjustable arms are independantly adjustable to hold the beam forming sheets in vertical and angled from vertical position providing beams with a predetermined draft or with no draft.

5. A light weight form for concrete beams according to claim 1 wherein said yokes are formed of hollow, square metal upright legs, a pair of angles secured to opposite sides of said legs form said at least one horizontal member, and said upper and lower adjustable arms are metal angles.

* * * * *